US007614355B2

(12) United States Patent
Zeyger

(10) Patent No.: US 7,614,355 B2
(45) Date of Patent: Nov. 10, 2009

(54) PERSONAL FLYING WATER JET APPARATUS

(75) Inventor: Eugene Zeyger, 5 Turtle Brook Way, Medfield, MA (US) 02052

(73) Assignee: Eugene Zeyger, Medfield, MA (US)

( * ) Notice: Subject to any disclaimer, the term of this patent is extended or adjusted under 35 U.S.C. 154(b) by 0 days.

(21) Appl. No.: 11/713,659

(22) Filed: Mar. 5, 2007

(65) Prior Publication Data

US 2008/0014811 A1 Jan. 17, 2008

Related U.S. Application Data

(60) Provisional application No. 60/819,878, filed on Jul. 12, 2006.

(51) Int. Cl.
*B63B 35/73* (2006.01)

(52) U.S. Cl. ..... 114/55.58; 440/38
See application file for complete search history.

(58) Field of Classification Search ..... 114/55.5; 440/38; 244/4 A

(56) References Cited

U.S. PATENT DOCUMENTS 6,095,428 A * 8/2000 Wells ..... 239/1
7,258,301 B2 * 8/2007 Li ..... 244/4 A

* cited by examiner

*Primary Examiner*—Ed Swinehart

(57) ABSTRACT

A personal flying water jet apparatus consisting of two towing connected units: one is a floating platform, mainly an inflatable Ski Tube (12A) (and so on), equipped with water jet nozzles (18) directed downward and mounted on both sides by means of brackets (20); the other is an inlet port (24) fixed on a tow line (16) and connected with nozzles (18) by mean of a hose (22). While the tube is being towed, the kinetic head appears and pressurized water is discharged at the nozzles (18) producing a thrust, so the rider (10) will fly. An additional version of the apparatus is: the nozzle (18) can be fixed on the rider's (10) back, so this lifting assembly performs like a Backpack, but the floating platform can be made in the shape of a life jacket (12B).

4 Claims, 2 Drawing Sheets

PERSONAL FLYING WATER JET APPARATUS

CROSS-REFERENCE TO RELATED APPLICATION

This application claims the benefit of provisional Patent Application No. 60/819,878, filed Jul. 12, 2006 by the present inventor.

FEDERALLY Sponsored Research

Not Applicable

BACKGROUND OF THE INVENTION

1. Field of Invention

This invention relates to motor water sport and recreation, mainly to towing floatation platforms (inflatable or on boards)

2. Prior Art

There are known, personal towing platforms equipped with hydrodynamic lifting force devices such as water skis, underwater wings, stepped hydroplanes, etc. When a tug reaches a certain speed, the platform lifts off the water's surface (partly or fully), but does not come off the water, because this devices require contact with the water. Such is a water craft, according to U.S. Pat. Nos. 5,697,317; 6,422,168.

There is a known, personal propulsion device having a body unit, a base unit, and a delivery conduit in water communication with both the body init and the base unit. The body unit includes a thrust assembly having thrust nozzles. The base unit includes an engine and a pump, which provides pressurized water to the delivery conduit. However, that unit is both expensive to produce and operationally challenging for the average user. Such is a device, according to U.S. Pat. No. 7,258,301.

OBJECTS AND ADVANTAGES

Several objects and advantages of the present invention are:

(a) To provide a compact personal water jet apparatus, such as towing inflatable tubes, which while being towed will come off of the water's surface and will fly. The apparatus is attractive to consumers as it provides a unique experience in the field of water sport for adults and children;

(b) To provide a set of universal technical solutions which allow the construction of the various versions of the apparatus to be lifted either under the action of the kinetic head which appears while being towed by a tug.

SUMMARY

In accordance with the present invention, the apparatus consists of two towing, connected units: one is a floating platform, mainly is an inflatable Ski Tube (and so on), equipped with water jet nozzles directed downward and mounted on both side by means of brackets; the other is an inlet port fixed on a tow line and connected with the nozzles by means of a hose. While the tube is been towed, the kinetic head appears and pressurized water is discharged at the nozzles providing a thrust, so the rider flies.

The nozzles can be fixed on the rider's back, so this lifting assembly performs like a Backpack, but the floating platform can be made in the shape of a life jacket.

DRAWINGS

Figures

DRAWINGS

Reference Numerals

| | |
|---|---|
| 10 | Rider |
| 12A | Towing flotation platform (Ski Tube version) |
| 12B | Towing flotation platform (Backpack version) |
| 14 | Tug |
| 16 | Tow line |
| 18 | Nozzle |
| 20 | Bracket |
| 22 | Hose |
| 24 | Inlet port |
| 26 | Tether |
| 28 | Float |
| 29 | Spoiler |
| 30 | Ball joint arm |

DETAILED DESCRIPTION

Figure 1A:
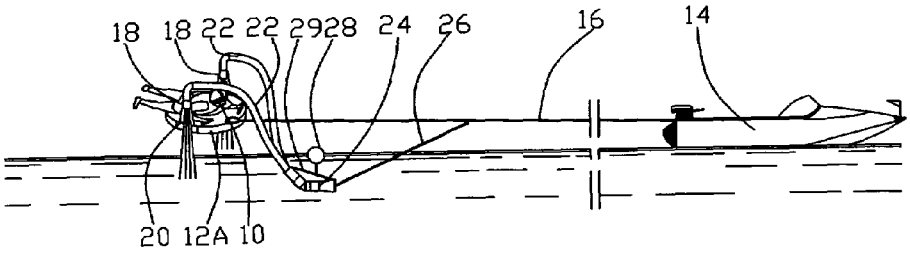
FIG. 1A shows the general view of the apparatus when made on the base of a Ski Tube.
Figure 1B:
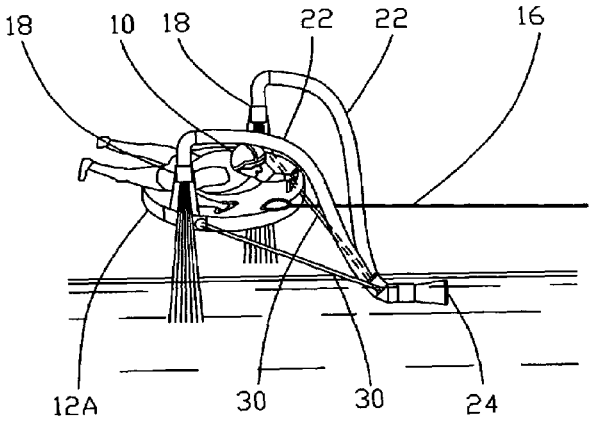
FIG. 1B shows a version of the towing Ski Tube when the inlet port is mounted directly on the tube.

FIG. 1A and 1B—Preferred Embodiment

A rider 10 (FIG. 1A) lies on a towing flotation platform 12A made on the base of a Ski Tube, which is connected to a tug 14 by means of a tow line 16. The Ski Tube 12A is equipped with nozzles 18 directed downward located above the water's surface and mounted on both sides by means of brackets 20. The nozzles 18 are connected with an inlet port 24 (made in the shape of a conical contraction) by a hose 22. The inlet port 24 is attached to the tow line 16 by means of a tether 26 and supported at the submerged position by a spoiler 29 and a float 28.

The inlet port 24 (FIG. 1B) may also be attached directly to the Ski Tube 12A by ball joint arms 30. It is also connected to the nozzles 18 by the hose 22, but the Ski Tube is connected to the tug 14 by the tow line 16.

Figure 1C:
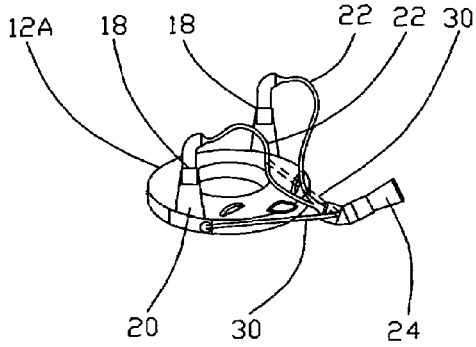
FIG. 1C shows a version of the towing Ski Tube when the inlet port is mounted directly on the tube in its folded position.

Operation—FIG. 1A, 1B and 1C

The Ski Tube 12A (FIG. 1A) is towed by the tug 14 by means of the tow line 16. When the tug 14 reaches a speed by which kinetic head at the inlet port 24 is sufficient enough to produce the needed pressure inside the hose 22, water is discharged at the nozzles 18 making a thrust sufficient enough to lift the rider 1 off the water's surface. Regardless of the height of the Ski Tube 24 above the water's surface, the inlet port 24 should be submerged. This is achieved by means of the spoiler 29 (anti-wing) which is connected to the tether 26. In order to prevent a vertical load from the tow line 16 (due to the volume of the lift force) the depth of the inlet port is limited by the float 28.

The apparatus shown in FIG. 1B works analogously to the apparatus in FIG. 1A. Owing to the ball joint arms 30, the inlet port 24 (together with the arms) can be folded in the direction of the Ski Tube (FIG. 1C) for compactness during transportation.

DETAILED DESCRIPTION

Figure 2A:
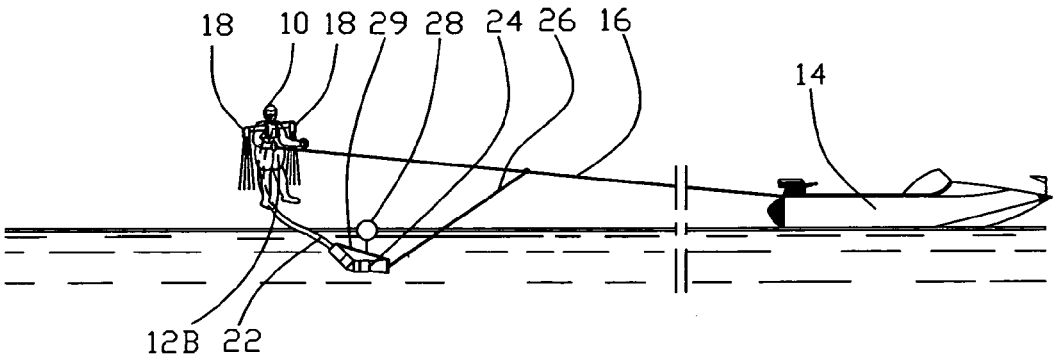
FIG. 2A shows the general view of the apparatus when made in the shape of a Backpack.
Figure 2B:
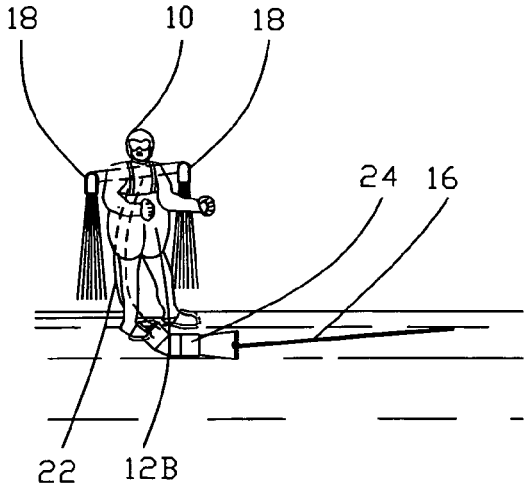
FIG. 2B shows a version of the towing Backpack when the inlet port is mounted directly on the rider's feet.

FIG. 2A and 2B—Additional Embodiment

The nozzles 18 (FIG. 2A) are mounted on both sides of a lifting assembly which performs like a Backpack, but the flotation platform 12B is made in the shape of a life jacket. The nozzles 18 are connected to the inlet port 24 by the hose 22 which passes behind the rider 10. The inlet port 24 hangs from the tow line 16 by means of a tether 26 and is supported at the submerged position by a spoiler 29 and a float 28.

Water-supply of the nozzles 18 (FIG. 2B) may also be realized by means of the inlet port 24 fixed on the rider's feet. The inlet port 24 is connected to the nozzles 18 by the hose 22 and is also connected to the tug 14 by the tow line 16.

Operation—FIGS. 2A and 2B

The rider 10 (FIG. 2A) puts on the Backpack 12B, which can be combined together with a life jacket. While been towed the rider 10, due to a lifting force (which appears analogous as said above), assumes a vertical position, so the rider moves as if stand on his/her feet on the water's surface.

The apparatus shown in FIG. 2B works analogously to the apparatus in FIG. 2A. Owing to the connection of the inlet port 24 to rider's feet and to the tow line 16, it is not necessary to install the spoiler 29 and the float 28.

CONCLUSION, RAMIFICATION, AND SCOPE OF INVENTION

In all the versions of the apparatus the center of thrust (located at the center of nozzle) is above the center of gravity (located at low point of human stomach). The positive distance between the center of thrust and center of gravity assures the vertical stability of the rider's body.

In all the versions of the apparatus the nozzles can be mounted with the possibility of independent rotational motion and operated by means of a steering handle bar, so the rider can change the direction of thrust for maneuverability.

In all versions of the apparatus the floating platform can be made not only inflatable, but also as a board and so on.

The apparatus can been towed: either by motor boat on open water, or by cable, such in cable water-ski resorts around the world.

Parameters of the real apparatus for rider weight of 175.0 lbs (80 kg) should be approximately: the tow speed—15.0 knots (31.0 km/h), the inlet port diameter—5.0" (125.0 mm), the hose diameter —3.0" (75.0 mm), the nozzles diameter-2.0" (50.0 mm).

The technical solutions, described above, show a wide variety of uses for the present invention for consumer and/or commercial use.

I claim:

1. A personal flying water jet apparatus consisting of first and second units, being towed along the water's surface by means of a tow line connected to a towing vessel, said first unit is a flotation platform for a rider which is made in the shape that is selected from the group consisting of either an inflatable tube on which the rider may lay, or a backpack which the rider puts on, and both said platforms are configured to be lifted above the water's surface by means of a hydrodynamic water jet lifting force, both of said first and second platforms are equipped with water jet nozzles directed downwardly, said second unit is a conical contraction inlet port located under the water's surface and configured for the supply of water to the water jet nozzles from a kinetic head which appears as a result of said apparatus is being towed by the towing vessel, the inlet port being connected with the nozzles by means of a flexible hose.

2. A personal flying water jet apparatus of claim 1, wherein said water jet nozzles are mounted on both sides of said floatation platforms by means of brackets.

3. A personal flying water jet apparatus of claim 2, wherein said platform is said backpack, and said water jet nozzles are located on either sides of a rider and are mounted on said backpack by means of brackets.

4. A personal flying water jet apparatus of claim 1, wherein said inlet port is fixed on the bottom of said inflatable tube by means of brackets, the inlet port is fixed on the rider's feet, or the inlet port is fixed to the tow line.

* * * * *